US005893298A

United States Patent [19]

Keister

[11] Patent Number: 5,893,298

[45] **Date of Patent: *Apr. 13, 1999**

[54] PRECISION SNAP-ON KNOB MECHANISM

[75] Inventor: James William Keister, Phoenix, Ariz.

[73] Assignee: Honeywell Inc.

[ * ] Notice: This patent issued on a continued prosecution application filed under 37 CFR 1.53(d), and is subject to the twenty year patent term provisions of 35 U.S.C. 154(a)(2).

[21] Appl. No.: 08/699,278

[22] Filed: Aug. 19, 1996

[51] Int. Cl.[6] ..... G05G 1/12

[52] U.S. Cl. ..... 74/553; 403/326; 13/121; 13/DIG. 30

[58] Field of Search ..... 74/553; 403/326, 403/327, DIG. 7; 16/41, 121, DIG. 30, DIG. 24

[56] References Cited

U.S. PATENT DOCUMENTS

| | | | |
|---|---|---|---|
| 2,149,375 | 3/1939 | Weibe | 292/247 |
| 3,064,494 | 11/1962 | Brewster | 74/553 X |
| 3,619,594 | 11/1971 | Morez | 74/553 X |
| 4,435,993 | 3/1984 | Scott | 74/553 |
| 5,309,798 | 5/1994 | Markwart | 403/327 X |
| 5,481,949 | 1/1996 | Yen | 403/327 X |

OTHER PUBLICATIONS

Product Catalog, Circa 1990–1991, Anderton –United Products, Inc., 500 Memorial Dr., P.O. Box 6723 Somerset, NJ. 08875–6723. Part No. 1100.

*Primary Examiner*—Charles A. Marmor
*Assistant Examiner*—Saúl Rodríguez
*Attorney, Agent, or Firm*—Charles J. Ungemach

[57] ABSTRACT

A knob securing mechanism secures a knob to a shaft. A uniquely shaped retaining clip attaches in a channel of the knob. The channel intersects a bore in the knob which receives the shaft. The shaft has a groove corresponding to the retaining clip such that the retaining clip and the groove couple when the knob is fully seated in the bore of the shaft. The retaining clip operates as a spring to resist axial motion between the knob and shaft. Ramps are formed on the shaft to facilitates both installing and removing the knob from the shaft by application of axial force. Locking lugs on the shaft engage corresponding locking lugs in the knob to secure the knob rotationally to the shaft. The invention is particularly useful for attaching translucent knobs to shafts of an avionics control panel.

5 Claims, 6 Drawing Sheets

SECTION B–B

SECTION A–A

Fig. 5A
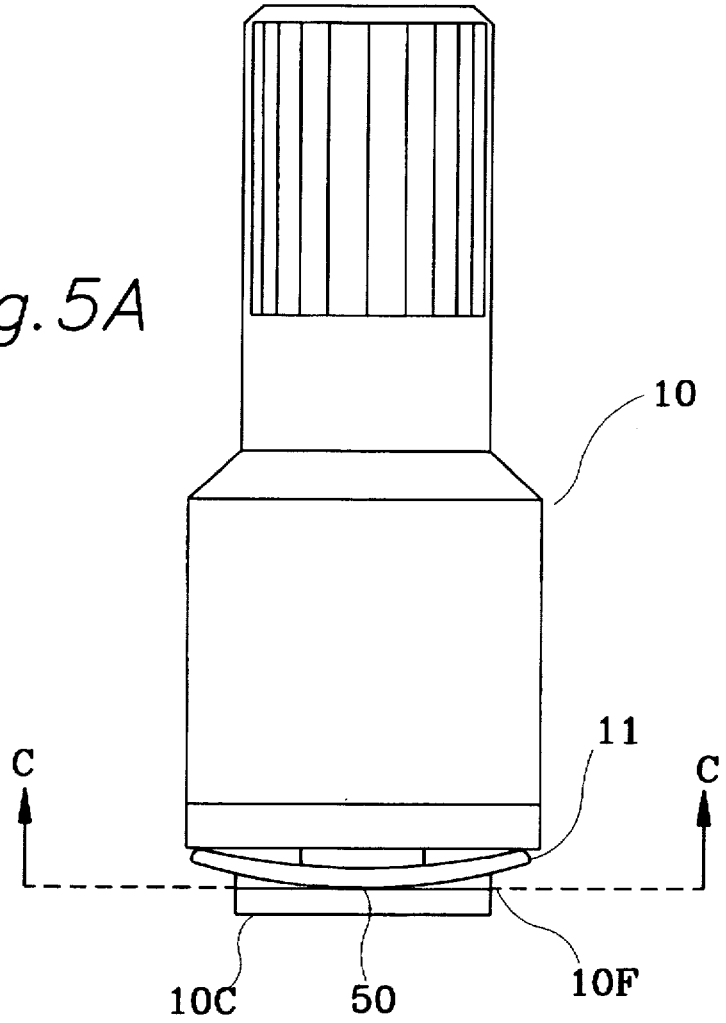
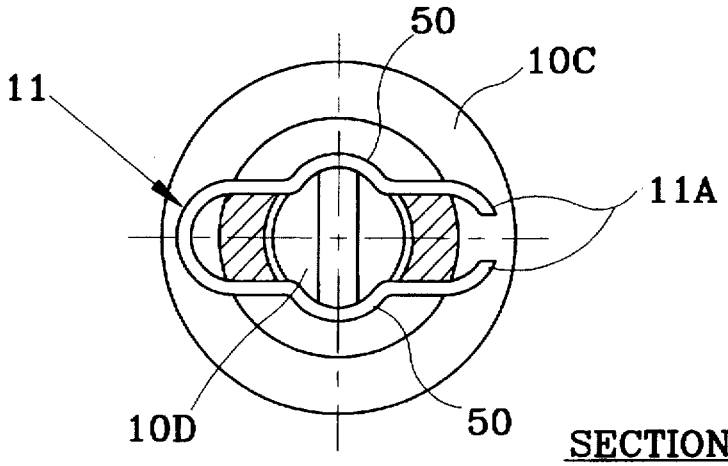
SECTION C–C
Fig. 5B

PRECISION SNAP-ON KNOB MECHANISM

BACKGROUND OF INVENTION

The present invention relates generally to control knobs and more specifically to snap-on type attachment mechanisms for securing a control knob to a shaft.

Control knobs are ubiquitous in our society. They are used in a wide range of products ranging from consumer products for the home to laboratory instruments and, in particular, aircraft control panels.

Control knobs typically attached to a control shaft thereby allowing an operator to easily manipulate(e.g. rotate) the control shaft. Knobs are attached to the shafts in numerous ways including screws, glue, clips, welds, bolts, cotter pins, and numerous other types of fasteners.

One particular application of control knobs are in the aviation industry Due to the demanding environment of an aircraft cockpit, avionics control knobs must meet or exceed strict regulation standards and pilot expectations One important aspect of theses regulations and expectations is illumination of control knobs Proper illumination is critical in an aircraft control panel for assisting a pilot to quickly locate and assess the status of a knob or associated control panel Precise illumination is even more critical at night when a pilot must locate and assess control knobs in reduced ambient light conditions.

To satisfy these illumination requirements the prior art uses carefully constructed control panels and control knobs The knobs are at least partially constructed of a translucent plastic material so that light from a light source is conducted through the knob to cause the desired illumination. For example, such a knob may be designed to illuminate a ring around the base of a knob or to illuminate a symbol(e.g. a pointer or letter) on the end of the knob.

To achieve this controlled illumination the knobs are painted to eliminate all light leaks except where light illumination is desired. Once the knobs are painted they must be carefully handled since a scratch in the paint often causes an unacceptable light leak requiring the scratched area to be repainted.

A second aspect of the regulations and expectations is positive connection of the knob to the shaft. It is undesirable to have any looseness or free play between the knob and shaft. To achieve the required positive connection the prior art uses two set screws to secure the knob to the shaft.

The problem of light leaks is exacerbated by the use of the set screws because scratches are easily caused by the tool used to tighten the set screws. When a scratch occurs the knob must be returned to the paint shop for touch up. Often the entire circuit card to which the knob and shaft are attached must be sent to the paint shop. The repair, therefore, not only results in wasted time and cost associated with touching up the knob, but also exposes the circuit card to the risk of damage. Second, if a knob is scratched for any reason after the control panel has been assembled then the control panel must be disassembled in order to remove the knob. In either case there is wasted time and excessive cost.

Manufacture and repair of aircraft control panels and the like would be improved by a control knob which is not scratched by installation tools, may be removed without disassembling the control panel, and provides a positive attachment between the knob and control Clearly there exists the need for a control knob attachment assembly which provides the benefits described above.

SUMMARY OF THE INVENTION

The invention discloses a knob securing mechanism which positively secures a knob to a shaft without the need for set screws or the like.

A uniquely shaped retaining clip attaches in a channel of the knob. The channel intersects a bore in the knob which receives the shaft. The shaft has a groove corresponding to the retaining clip such that the retaining clip and the groove couple when the knob is fully seated on the shaft. The retaining clip operates as a spring to resist axial motion between the knob and shaft.

Ramps are formed on the shaft to facilitates both installing and removing the knob from the shaft by application of axial force. Locking lugs on the shaft engage corresponding locking lugs in the bore of the knob to secure the knob rotationally to the shaft. The invention is particularly useful for attaching translucent knobs in aviation applications.

Two key elements of the invention are the unique retaining clip and the ramps formed in the shaft. These elements allow a knob to be positively secured to a control shaft as required in aviation applications. The invention eliminates scratches caused by tools for tightening set screws because set screws are no longer needed. The retaining clip, groove, and locking lugs together eliminate the need for set screws.

The invention also eliminates the need to disassemble a control panel to replace a knob. The knobs are easily seated or unseated merely by applying sufficient axial force to the knob(i.e. the knobs "snap" on and off).

The retaining clip has several unique features. First, the clip is bent such that it operates like a spring when coupled to the groove of the shaft. The bend is shown in FIG. 2B. The spring feature of the retaining clip allows the clip to exert axial tension between the knob and shaft which gives an operator the feeling that the knob is positively secured to the shaft. In other wordS, the spring feature eliminates free play between the knob and shaft.

Another feature of the retaining clip are the inward flared or hooked ends which attach the clip to the knob. The hooked ends, shown in FIG. 2A, are flared inward as opposed to being flared outward as prior art clips are shaped.

Two ramps are formed on the shaft to facilitate installing and removing the knob. When the clip is installed on the knob, the bore of the knob is partially obstructed by a portion of the clip which extends into the bore. The insertion ramp on the shaft facilitates insertion of the shaft by displacing the clip so that the shaft can be inserted into the bore. Similarly, an extraction ramp facilitates extraction of the shaft from the knob. The extraction ramp forms a side of the groove in the shaft. When sufficient axial force is applied, the extraction ramp causes the clip to be displaced from the bore thus permitting the shaft to be extracted. Without the ramps insertion and extraction of the shaft would require excessive force and cause damage to the retaining clip.

The locking lugs on the shaft and the locking lugs in the bore of knob prevent rotational movement between the knob and shaft. Many different embodiments of the locking lugs are contemplated. The most important requirement of the locking lugs is that they interlock with one another to prevent rotational movement between the knob and the shaft when the knob is seated on the shaft.

The unique retaining clip, the groove in the shaft, the insertion and extraction ramps, and locking lugs of the invention are a significant improvement over the set screws used in the prior art.

Therefore, objects of the invention are to provide a snap-on knob assembly which reduces costs, reduces the incidence of scratching, and eliminates the need to disassemble a control panel to remove a knob.

A feature of the invention is a retaining clip which functions as a spring.

Another feature of the invention is a retaining clip with ends which are flared inward.

Another feature of the invention are the insertion and extraction ramps.

Yet another feature of the invention are the interlocking lugs of the knob and shaft.

An advantage of the invention is an avionics control knob which does not require set screws for attaching to a control shaft.

Another advantage of the invention is a knob which is easily installed and removed.

The significant features of the invention are illustrated in the figures and described more fully below.

BRIEF DESCRIPTION OF THE DRAWINGS

FIG. 5A is a knob with a retaining clip.

FIG. 5B is the knob and retaining clip viewed along section C—C.

DETAILED DESCRIPTION

Figure 1:
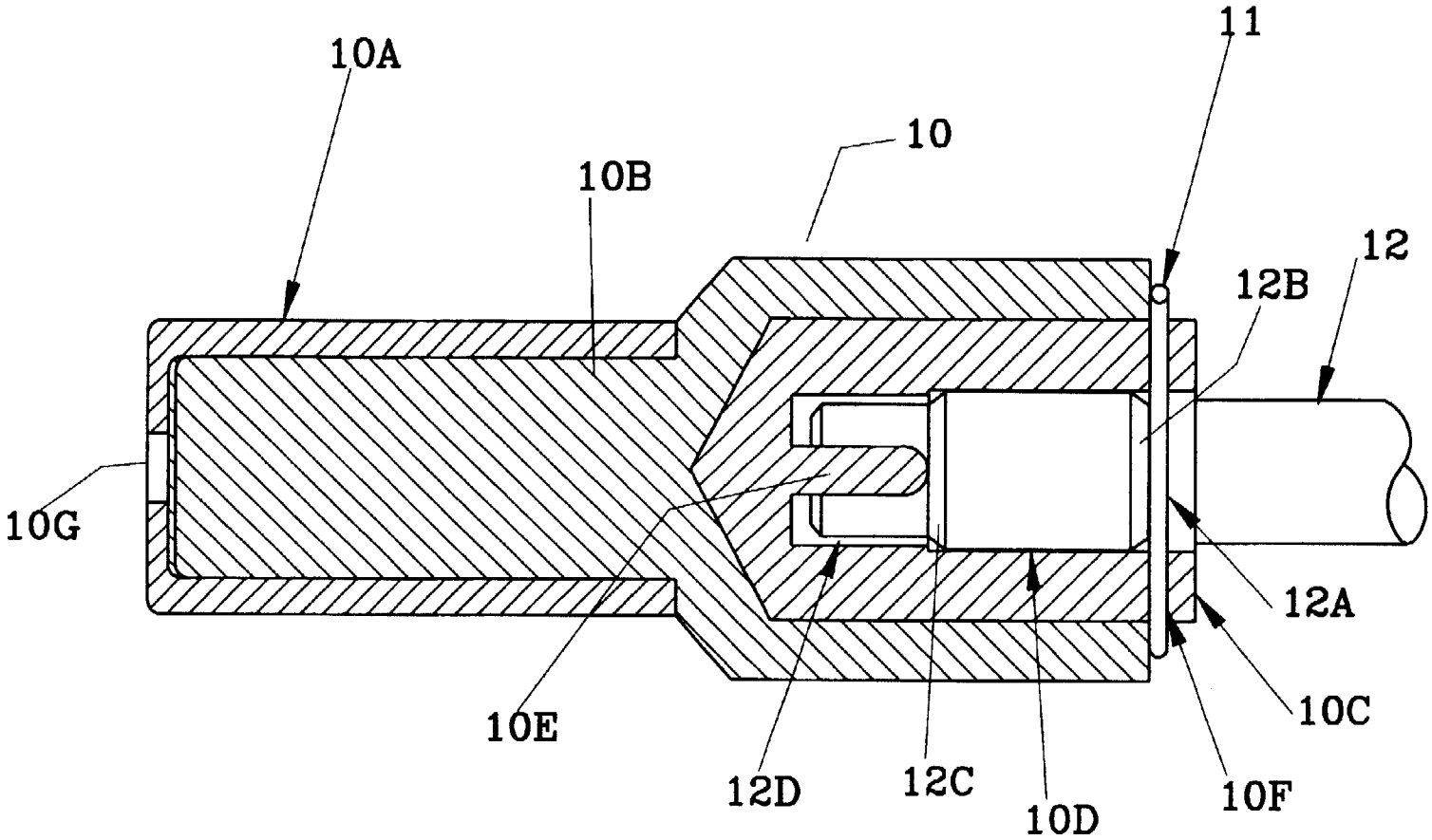
FIG. 1 is a sectional view of a knob with a retaining clip an shaft.

FIG. 1 is a sectional view of a knob showing the coupling of the knob and a shaft according to the invention Shown in FIG. 1 are knob 10, retaining clip 11, and shaft 12. Elements of knob 10 include sleeve 10A, translucent portion 10B, insert 10C, bore 10D, knob locking lug 10E, and channel 10F. Elements of shaft 12 include groove 12A, extraction ramp 12B, insertion ramp 12C, and shaft locking lugs 12D.

Knob insert 10C encompasses several aspects of the invention Bore 10D, channel 10F, and lug 10E are integral elements of insert 10C. Insert 10C is preferably made of metal and is machined and or cast to create the desired shape. Bore 10D is formed using known techniques and is appropriately shaped to allow insertion of shaft 12. Channel 10F is formed to receive retaining clip 11 and is illustrated with retaining clip 11 in place. Knob lug 10E is intended to couple with the locking lugs 12D of shaft 12 to prevent rotational movement between the knob 10 and shaft 12. Many alternate embodiments of knob lug 10E and shaft lugs 12D are envisioned The preferred embodiment, described below, uses a rod to perform the function of knob lug 10E.

Insert 10C is encased by translucent portion 10B. Translucent portion 10B is typically made of a translucent plastic Surfaces of translucent portion 10B are carefully painted to precisely control light entering and escaping translucent portion 10B. Sleeve 10A is a removable sleeve which prevents light leaks and often includes an aperture 10G in a desired shape (such as a pointer).

Retaining clip 11 is shown positioned in channel 10F and coupled with groove 12A. In this embodiment, channel 10F is just wide enough so that clip 11 fits precisely into the channel 10F. In the preferred embodiment discussed below, channel 10F is wider than clip 11 to allow clip 11 to function like a spring.

Shaft 12 is shown fully seated into the bore 10D of knob 10. Groove 12A is formed in shaft 12 and is perpendicular to the axis of shaft 12. Extraction ramp 12B forms the forward side of groove 12A. Extraction ramp 12B displaces clip 11 when force is applied to separate knob 10 from shaft 12. Once clip 11 is sufficiently displaced, shaft 12 is easily separated from knob 10.

Insertion ramp(or forward ramp) 12C performs the opposite function of extraction ramp 12B. Insertion ramp 12C displaces clip 11 when shaft 12 is inserted into bore 10D.

Shaft locking lugs 12D mate with knob locking lug 10E to prevent rotational movement between knob 10 and shaft 12. A great variety of locking lugs 12D and 10E(also referred to generically as locking surfaces) are envisioned The preferred embodiment is discussed below.

Figure 2A:
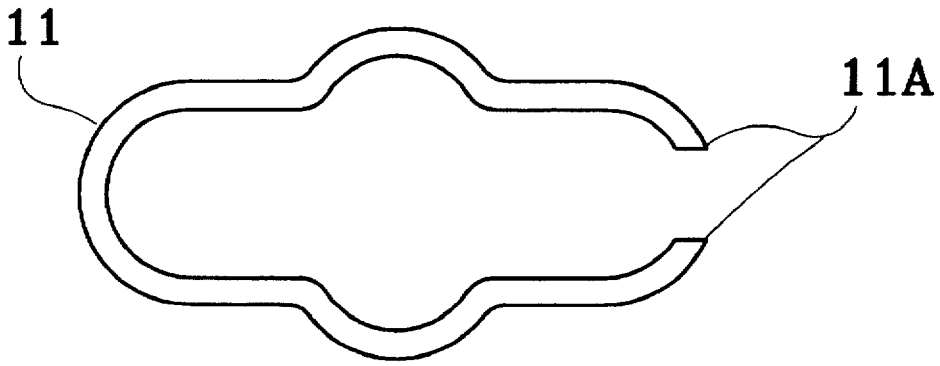
FIG. 2A is a retaining clip (flat).
Figure 2B:
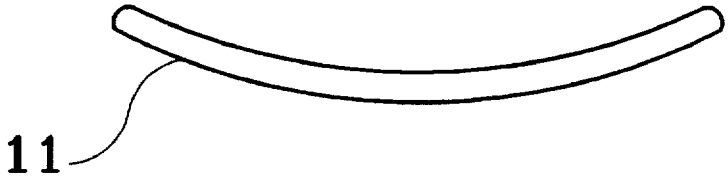
FIG. 2B is a side view of the retaining clip.

FIGS. 2A and 2B show retaining clip 11. FIG. 2A shows retaining clip 11 flat(i.e. without a bend) Ends of clip 11A flare inward forming hooks which secure clip 11 to knob insert 10C.

Clip 11 is bent so that clip 11 functions like a spring to resist axial motion between knob 10 and shaft 12. The bend imparted to clip 11 is illustrated in FIG. 2B which is a side view of clip 11.

Figure 3A:
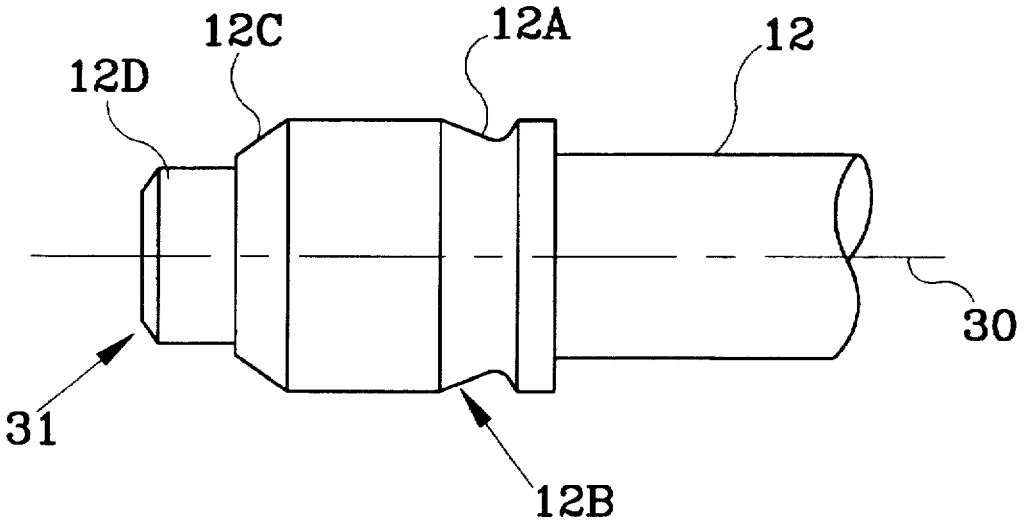
FIG. 3A is a side view of a shaft.
Figure 3B:
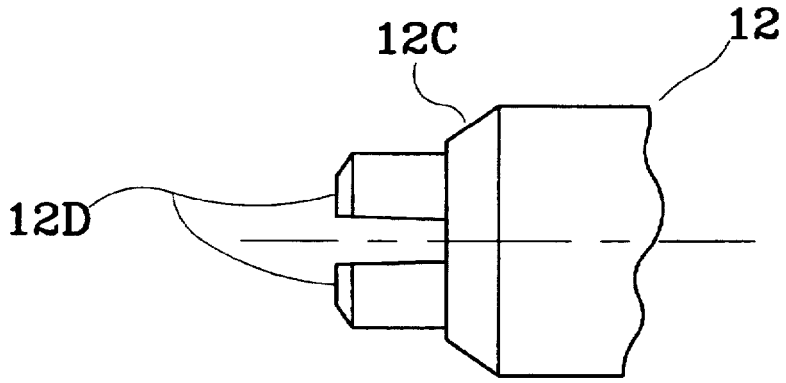
FIG. 3B is the shaft of FIG. 3A rotated 90 degrees

FIGS. 3A and 3B are detailed views of shaft 12. The basic shape of shaft 12 is preferably cylindrical, however, the invention can be adapted to alternate shapes The axis of shaft is shown by dash line 30. Arrow 31 indicates the front of shaft 12. Extraction ramp 12B forms the forward side of groove 12A. In the preferred embodiment, extraction ramp 12B is inclined 22.5 degrees relative to the axis of shaft 12 and insertion ramp 12C is inclined 20 degrees relative to the axis of shaft 12. Groove 12A, extraction ramp 12B, and insertion ramp 12C are formed around the entire circumference of shaft 12 making additional views of these features unnecessary.

The view of shaft locking lugs 12D, however, do change as shaft 12 is rotated FIG. 3B illustrates shaft locking lugs 12D when shaft 12 is rotated 90 degrees from FIG. 3A.

FIGS. 4A through 4D show knob 10 in detail.

Figure 4B:
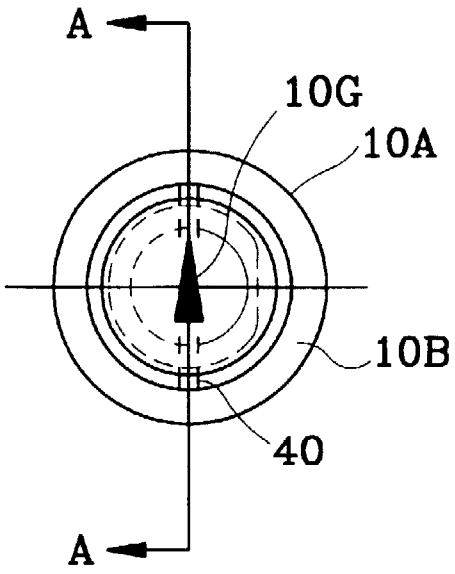
FIG. 4B is the knob as viewed along the axis.
Figure 4A:
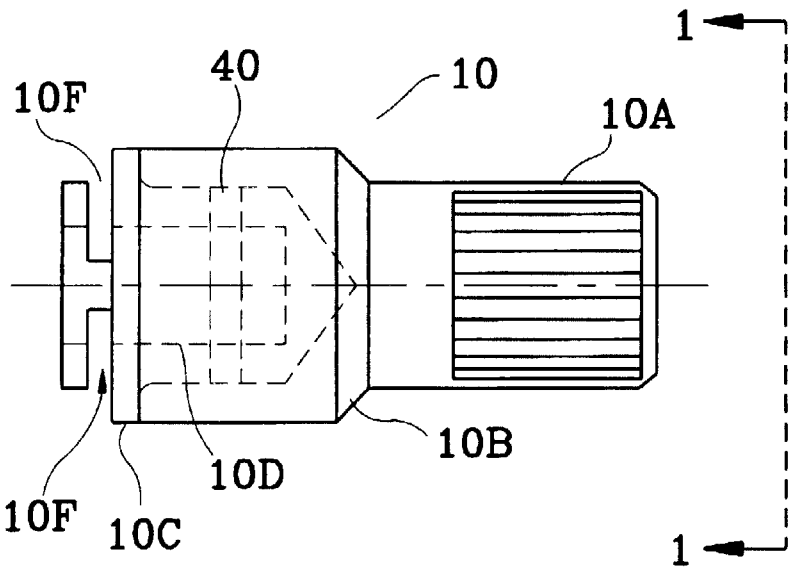
FIG. 4A is a side view of a knob.

FIG. 4A further illustrates knob 10. Insert 10C is partially encased by translucent material 10B as indicated by dashed lines. Also shown are sleeve 10A, translucent portion 10B, channel 10F, and bore 10A.

The preferred embodiment for the knob locking lug 10E is also shown In this embodiment a hole is drilled through insert 10C and a metal rod is inserted thus forming a locking surface 40 which mates with shaft locking lugs 12D.

FIG. 4B shows knob 10 along view 1—1 of FIG. 4A. Shown in FIG. 4B are aperture 10G shaped as a pointer, sleeve 10A, and translucent portion 10B. Shown as hidden or dash lines are bore 10D, the interior surface of sleeve 10A, and knob locking surface (i.e. rod) 40.

Figure 4D:
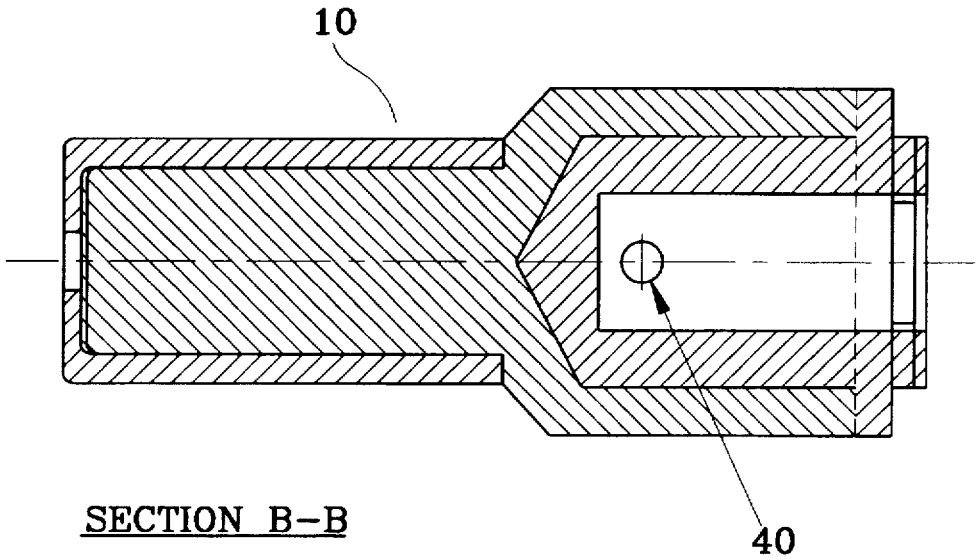
FIG. 4D is the knob viewed along section B—B.
Figure 4C:
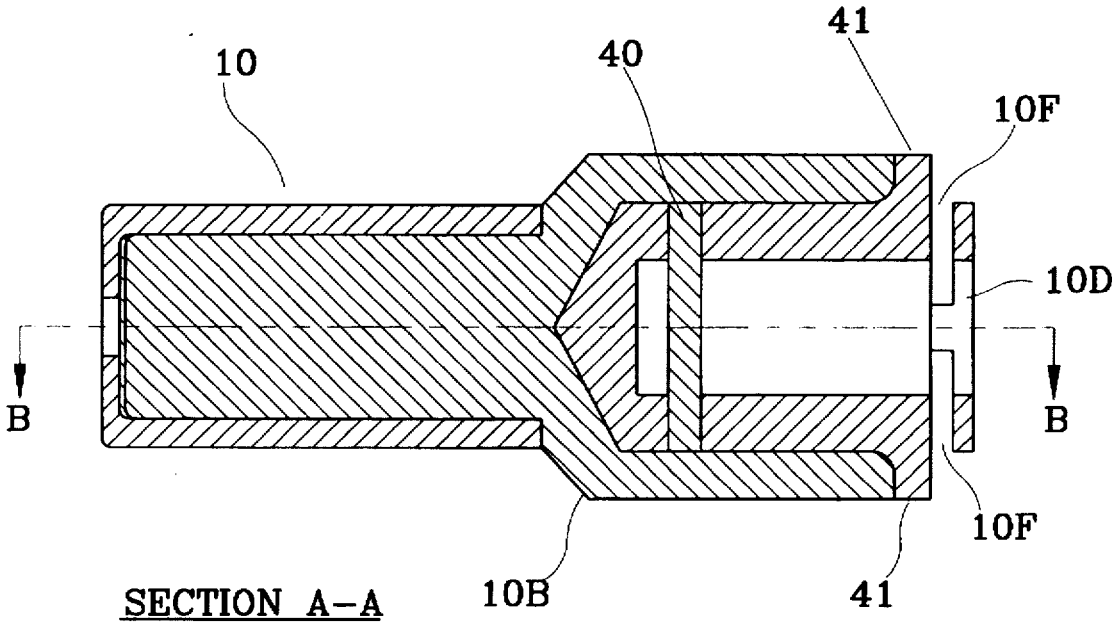
FIG. 4C is the knob viewed along section A—A.

FIG. 4C shows knob 10 along view A—A of FIG. 4B. This figure particularly illustrates knob locking surface 40, bore 10D, and channel 10F. Knob locking surface 40 is shown as the preferred embodiment of a rod which is inserted through a hole which is drilled through knob 10. This embodiment is preferred because of the ease of manufacturing.

FIG. 4C also illustrates the preferred embodiment of insert 10A. A flared portion 41 improves manufacturing by retaining the molten plastic material which forms translucent portion 10B.

Channels 10F are shown intersecting bore 10D. This is required since clip 11 must extend into bore 10D to couple with groove 12A.

FIG. 4D shows knob 10 along view B—B of FIG. 4C. This figure better illustrates locking surface 40 and channels 10F.

FIGS. 5A and 5B illustrate the preferred embodiment of chip 11 and channel 10F. Channel 10F is shown sufficiently wider than the width of clip 11 such that clip 11 is able to bend and function like a spring.

Clip 11 is shown installed with the ends(as shown) extending upward toward the top of the sheet. The center portion of clip 11 is protruding downward toward the bottom of the sheet. When the shaft is fully seated into the bore of knob 10, the center portion 50 of clip 11 couples with the groove of the shaft. Clip 11 operates like a spring to exert tension against a side of the groove thereby eliminating any looseness between the knob and shaft.

It has been observed that clip 11 may also be installed in the opposite position(i.e. ends extending down and center portion protruding upward). The position of clip 11 should be tested in both positions to find which works best for a particular application.

FIG. 5B illustrates the knob and the clip along view CC of FIG. 5A. The flared ends 11A of clip 11 attach around a portion of insert 10C. The center portions 50 of clip 11 extend into bore 10D

This description has been for descriptive purposes only and is not intended to limit the scope of the invention Those skilled in the art recognize numerous alternate embodiments of the invention which deviate from the described embodiment but still perform the same work in substantially the same way to achieve substantially the same result and are therefore equivalent to the invention.

It is clear from the foregoing that the present invention represents a new and useful snap-on knob mechanism.

The embodiments of an invention in which an exclusive property or right is claimed are defined as follows:

1. An apparatus for securing a translucent knob to a shaft extending generally along an axis from a control panel in an aircraft cockpit, said apparatus comprising:

a) a knob having a translucent portion and further having,
   1) a bore having a diameter, and,
   2) a channel intersecting said bore, said channel having first and second edges with a surface extending parallel to the direction of the axis between the first and second edges b) a shaft having a diameter less than the diameter of said bore, said shaft also having a groove perpendicular to the axis; and, c) a retaining clip having first and second laterally extending sides, attached in said channel of said knob such that the sides of said clip extend into said bore and couple with said groove when said shaft is inserted into said bore, said retaining clip being bent in a direction parallel to the axis by an amount sufficient to allow a first portion of the legs to bear against the first edge and a second portion of the legs to bear against the second edge to produce a spring force in opposite directions against the first and second edges to resist axial motion between said knob and said shaft.

2. The apparatus for securing a translucent knob to a shaft according to claim 1 wherein said retaining clip is "U" shaped with the legs each extending to ends that are formed with a hook portion bending towards each other for attaching said clip to said knob.

3. A snap-on knob apparatus comprising:

a) a knob having,
   1) a bore extending along a first axis and having a first diameter and,
   2) a channel intersecting said bore, said channel being formed in said knob to provide first and second edges spaced apart in a direction parallel to the first axis;

b) a shaft extending along the first axis, said shaft having an end portion, having a diameter less than the first diameter and having,
   1) a groove, said groove substantially perpendicular to the first axis,
   2) a extraction ramp portion formed along the shaft in the end portion; and, c) clip means, positioned in said channel, for coupling with said groove when said shaft is inserted into said bore thereby constraining motion of said shaft in said bore along the first axis, and wherein said clip means is bent in the direction of the first axis, such that when said clip means is coupled with said groove, first and second portions of said clip means press against the first and second edges respectively so as to produce oppositely directed forces to resist axial motion between said knob and said shaft.

4. The snap-on knob apparatus according to claim 3 wherein a portion of said knob is translucent.

5. The snap-on knob apparatus according to claim 3 wherein said clip means comprises a "U" shaped member having legs, the ends of which are bent towards each other to form hook portions for securing said clip means to said knob.

* * * * *